US012723429B2

(12) United States Patent
O'Neal

(10) Patent No.: US 12,723,429 B2
(45) Date of Patent: Sep. 1, 2026

(54) LOUVERED PANEL BRACKET

(71) Applicant: Gary Allen O'Neal, Austin, TX (US)

(72) Inventor: Gary Allen O'Neal, Austin, TX (US)

( * ) Notice: Subject to any disclaimer, the term of this patent is extended or adjusted under 35 U.S.C. 154(b) by 158 days.

(21) Appl. No.: 18/908,736

(22) Filed: Oct. 7, 2024

(65) Prior Publication Data

US 2025/0116131 A1 Apr. 10, 2025

Related U.S. Application Data

(60) Provisional application No. 63/624,821, filed on Jan. 25, 2024, provisional application No. 63/588,751, filed on Oct. 8, 2023.

(51) Int. Cl.
*E04H 17/14* (2006.01)

(52) U.S. Cl.
CPC ..... *E04H 17/1488* (2021.01)

(58) Field of Classification Search
USPC ..... 256/65.03
See application file for complete search history.

(56) References Cited

U.S. PATENT DOCUMENTS 4,938,445 A * 7/1990 Medley ..... E04F 10/08 248/300

2015/0240516 A1 8/2015 Bertato

* cited by examiner

*Primary Examiner* — Adam C Ortiz
(74) *Attorney, Agent, or Firm* — The IP Gnome, LLC

(57) ABSTRACT

A louvered fence bracket comprising at least two bracket portions, each comprising a rectangular bracket body, a first sliding prevention portion attached perpendicularly to a width of the rectangular bracket body, and at least one second sliding prevention portion attached perpendicularly to a length of the rectangular bracket body, at least one parallelogrammatic support body portion comprising a first short side and a second short side and attaches to a second length of the rectangular bracket body of one of the at least two bracket portions by the first short side and the length of the rectangular bracket body of another of the at least two bracket portions by the second short side to align the at least two bracket portions at a desired angle and a desired spacing, and at least one fastener receiver for attaching the louvered fence bracket to a fencing post using a fastener.

20 Claims, 10 Drawing Sheets

LOUVERED PANEL BRACKET

CONTINUITY AND CLAIM OF PRIORITY

This is a U.S. non-provisional patent application claiming the benefits and priorities of U.S. provisional Patent Application Ser. No. 63/588,751, filed on Oct. 8, 2023, and U.S. provisional Patent Application Ser. No. 63/624,821, filed on Jan. 25, 2024, both of which are incorporated by reference.

BACKGROUND OF THE INVENTION

Technical Field

The invention relates to improving methods and apparatus for making brackets for fences, and more particularly, the invention relates to improving methods and apparatus for making brackets for louvered panels. fences.

Description of Related Art

Louvered panels, also known simply together as a louver, are parallel horizontal panels or slats that are usually arranged in even spacing and unform angle. In the past, louvered panels have been utilized mainly with windows because they allow for ventilation and penetration of natural light while keeping out rain, snow, and heat.

BRIEF SUMMARY OF THE INVENTION

The present invention is a louvered fence bracket for retaining multiple louver boards, also called louvers, louver panels, or slats, in a desired angle and a desired spacing for a fence or a similar structure, such as a pergola. The louvered fence bracket comprises at least two bracket portions and at least one parallelogrammatic support body portion. Each bracket portion is comprised of a rectangular bracket body, a first sliding prevention portion, and at least one second sliding prevention portion. The first sliding prevention portion is attached perpendicularly to a width of the rectangular bracket body to form an end bracket for receiving and retaining a louver board. The at least one second sliding prevention portion is attached perpendicularly to a length of the rectangular bracket body to form at least one side bracket for receiving and retaining the louver board. The at least one parallelogrammatic support body portion is comprised of a first short side, a second short side, and at least one fastener receiver. The at least one parallelogrammatic support body portion attaches to a second length of the rectangular bracket body of one of the at least two bracket portions by the first short side and the length of the rectangular bracket body of another of the at least two bracket portions by the second short side to align the at least two bracket portions at the desired angle and the desired spacing. The at least one fastener receiver attaches the louvered fence bracket to a fencing post using a fastener.

In an embodiment, the at least two bracket portion is at least three bracket portions and the at least one parallelogrammatic support body portion is at least two parallelogrammatic support body portions. In such embodiment, a first bracket portion is connected to a second bracket portion with a first parallelogrammatic support body portion and the second bracket portion is connected to a third bracket portion with a second parallelogrammatic support body portion. In an embodiment, the first bracket portion is welded to the second bracket portion with the first parallelogrammatic support body portion and the second bracket portion is welded to a third bracket portion with a second parallelogrammatic support body portion to form the louvered fence bracket. In an embodiment, the at least one second sliding prevention portion of each of the at least three bracket portions may be at least two second sliding prevention portions to form at least two side brackets. The at least one fastener receiver of each of the at least two parallelogrammatic support body portions may be at least one hole for attaching the louvered fence bracket to the fencing post using at least one screw. The material for the louvered fence bracket may be comprised of one or more of sheet metal, plastic, or resin. In an embodiment, the louvered fence bracket may further comprise at least one louver support for preventing twisting and warping of at least one louver board. In an embodiment, the louvered fence bracket may further comprise at least one cap board for securing at least one louver board in place in the louvered fence bracket.

Another embodiment of the present invention is a louvered fence bracket system for retaining multiple louver boards in a desired angle and a desired spacing for a fence or a similar structure, the louvered fence bracket system. The louvered fence bracket system is comprised of at least one louvered fence bracket, a side support board, and a fascia mount. Each louvered fence bracket is comprised of a vertical bracket body, a sliding prevention portion, a top connection portion at the top end of the vertical bracket body, and a bottom connection portion at the bottom end of the vertical bracket body. The vertical bracket body has a height, a top end with an alignment receiver and a notch forming portion, and a bottom end with a notch forming portion. The sliding prevention portion attaches at the desired angle to a first side of the vertical bracket body for receiving and retaining a louver board. Multiple louvered fence brackets can be connected together by connecting the top end of one of the at least one louvered fence bracket to the bottom end of another one of the at least one louvered fence bracket. A notch forms from the notch forming portion of the top end of the one of the at least one louvered fence bracket and the notch forming portion of the bottom end of the another one of the at least one louvered fence bracket when connected. The side support board attaches to each of the vertical bracket body of the at least one louvered fence bracket using the alignment receiver of the top end and retaining ends of the louver boards in place. The fascia mount attaches perpendicularly to the side support board and is for aligning a second side of vertical bracket body of each of the at least one louvered fence bracket and is adapted for attaching the louvered fence bracket system to the fence post.

In an embodiment, the sliding prevention portion further comprises a bend adapted for receiving and retaining an edge of the louver board. In an embodiment, the fascia mount may further be adapted for overlaying the fence post. In an embodiment as shown in FIGS. 3 and 4, the fascia mount may be a fascia board. In another embodiment, the fascia mount may be a metal L-bracket fascia. In an embodiment, the louvered fence bracket system may further comprise at least one louver support for preventing twisting and warping of at least one louver board. The material for the louvered fence bracket system may be comprised of one or more of sheet metal, plastic, or resin. In an embodiment, the louvered fence bracket system may further comprise at least one cap board for securing at least one louver board in place in the louvered fence bracket system. The at least one cap board may be secured to the vertical bracket body of the louvered fence bracket by at least one L-bracket.

In an embodiment, the multiple louvered fence brackets may be connected by welding together the top end of the vertical bracket body of one of the at least one louvered fence bracket and the bottom end of the vertical bracket body of another one of the at least one louvered fence bracket, thereby forming one continuous louvered fence bracket body. In such embodiment, the louvered fence bracket system may further comprise at least one cap board for securing at least one louver board in place in the louvered fence bracket system. The at least one cap board may have a zigzag shape to cover multiple louvered fence brackets and multiple louver boards. The zigzag shape of each of the at least one cap board may be comprised of at least one short portion and at least one long portion. Each of the short portion may be shaped to cover a top of one of the sliding prevention portion of the at least one louvered fence bracket and a top of one of the multiple louver boards held by the respective louvered fence bracket.

Methods of making the louvered fence bracket and the louvered fence bracket system are also described herein.

BRIEF DESCRIPTIONS OF THE DRAWINGS

DETAILED DESCRIPTION

Figure 1:
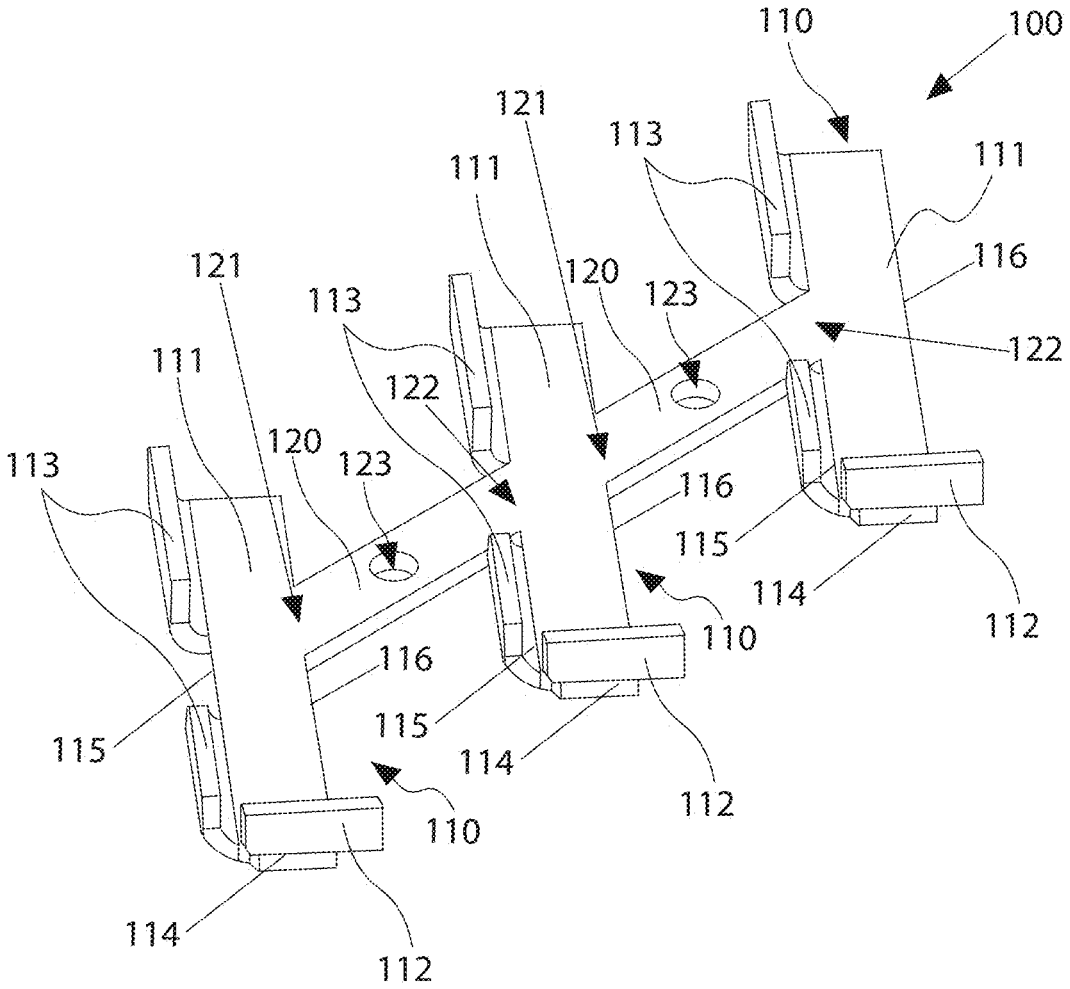
FIG. 1 is a perspective view of an embodiment of a louvered fence bracket, with three bracket portions and two parallelogrammatic support body portions.

Louver boards are aesthetically pleasing and enhance privacy as it is harder to peek through them due to their design. Because of their advantages, louvered boards have been further utilized in many applications including fencing, roofs, wind breaks, shower areas, enclosed areas under decks, and interior room dividers. Modern louver boards are often constructed with aluminum, metal, wood, or glass. Louvered fences, or louver fencings, have become a popular choice for those who want enhanced privacy and seclusion of their property while allowing for increased airflow than traditional wooden fences can provide. Louvered fences are therefore used in many commercial and residential purposes.

The standard method of producing louvered fencing includes numerous repetitive measurements to establish each louver board's required spacing and angle for each individual louver board. Extensive measurements are necessary for the desired appearance of each louver board's spacing, centering, angle, and leveling. Repeating these actions for each louver board requires the constructor's investment of substantial time and materials. After completing measurements, the louver boards must also be affixed to the post through methods including but not limited to 1) cutting slots into the post using a guide or a jig, 2) affixing the louver board to the post with nails making cuts into the post, and 3) using highly skilled techniques of nailing louver boards in place. Methods used depend on the skill of the constructor and the cost and availability of materials. The stability of each louver support requires several screws for attachment, which must accurately align to provide the desired parallel finished appearance. Repeating these actions on each supporting post of the fence also requires investment of substantial time and materials. Materials commonly used to support the louver boards, including wood and plastic, have a limited useful life and are susceptible to environmental damage and decay. Therefore, skilled carpentry is required on every step to achieve the desired level of consistency and quality, leading to high labor costs. If not done correctly and accurately, a quality product may not be achieved, resulting in disappointment and frustration among the persons involved, and lead to setbacks in construction time and cost through redoing work or repurchasing materials that were made unusable.

The louvered fences that are currently available are cumbersome to put together, mainly when assembled by unskilled labor. Therefore, a means to construct louvered fence accurately in spacing and angle in less time while reducing the skill, materials, and fasteners required to build a louvered fence is needed. Consequently, a novel bracket designed to simplify and expedite the construction of louvered fences while maintaining quality is provided.

With a general reference to FIGS. 1-9, the louvered fence bracket 100 and the louvered fence bracket system 200 provide many advantages over the prior arts. The louvered fence bracket 100 and the louvered fence bracket system 200 are designed for ease of installation as they are easily attachable to fence posts 603 (see FIGS. 2 and 4) and louver boards 500 (see FIGS. 2 and 4), allowing for a secure and straightforward assembly process, while significantly reducing the time required for louvered fence assembly compared to traditional methods. Further, the louvered fence bracket 100 and the louvered fence bracket system 200 ensure a high-quality and visually appealing finished fences by providing precise alignment and spacing of louver boards 500, thereby offering improvements in qualities of the fences. Furthermore, the louvered fence bracket 100 and the louvered fence bracket system 200 reduce the required skill of the person building the fence, as the louvered fence bracket 100 and the louvered fence bracket system 200 can be accurately installed by a person with minimal training, construction skill, and experience, using less number of fasteners than required by traditional louver fences per louver board 500, and no measurement is required. Using the louvered fence bracket 100 or the louvered fence bracket system 200, an individual can safely construct a louvered fence without assistance from others. Additionally, the louvered fence bracket 100 and the louvered fence bracket system 200 allows significantly more airflow than non-louvered fences and provide the appropriate overlap for louver boards 500, ensuring personal privacy screening.

The louvered fence bracket 100, or the substantially similar louvered fence bracket 210 of the louvered fence bracket system 200, can be made from any material that can be formed into a correct shape for the louvered fence bracket 100 or the louvered fence bracket 210 of the louvered fence bracket system 200 and withstand the weight and stresses typical for fence brackets. Materials used should be resistant to corrosion in outdoor environments. The material for the louvered fence bracket can be, but are not limited to, sheet metal, plastic, and resin. For example, sheet metals such as aluminum, carbon steel, stainless-steel, galvanized steel, powder-coated steel, Corten steel (also known as weathering steel) with thicknesses of 0.5 mm to 3 mm can be used. Plastics such as polycarbonate, thermoplastic polyolefin (TPO), acrylic, acrylonitrile butadiene styrene (ABS) can be used. Various types of resin and composites can be also used.

The louvered fence bracket 100 or the louvered fence bracket 210 of the louvered fence bracket system 200 may attach to fence posts, such as wood, using standard, readily available fasteners, such as nails, bolts, and screws. Other means known in the art for attaching a fence bracket to a fence post may be used. For a more permanent fence, a number of recycled materials can be used as fence posts as well.

Figure 2:
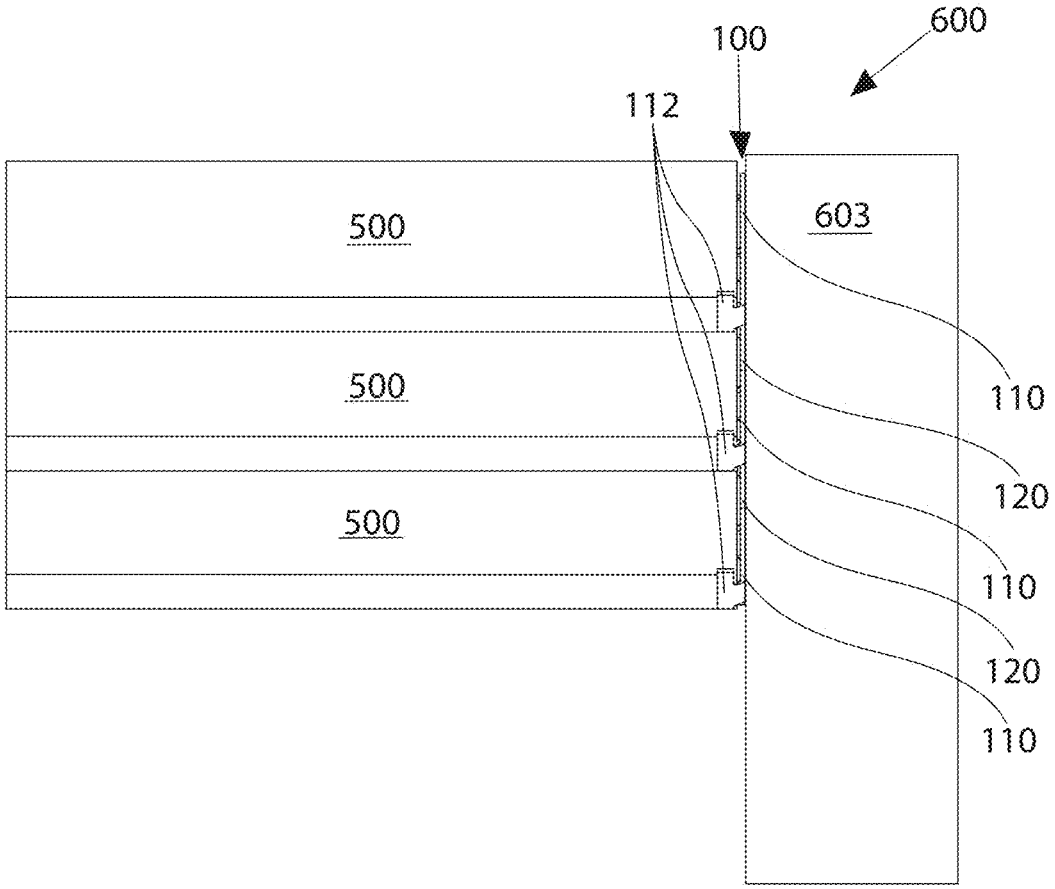
FIG. 2 is a front view of an embodiment of a louvered fence bracket on a fencing post, showing how multiple louver boards are retained in desired angle and spacing.
Figure 4:
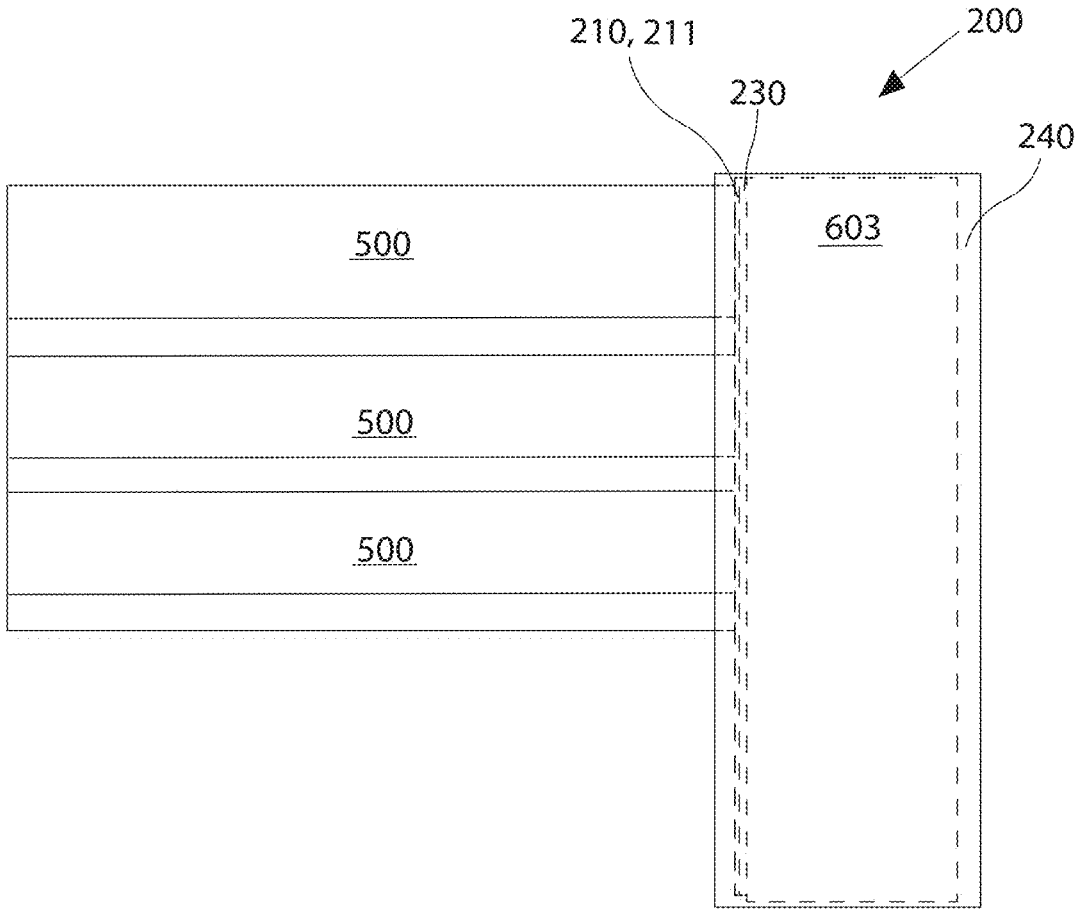
FIG. 4 is a front view of an embodiment of a louvered fence bracket system on a fencing post, showing how multiple louver boards are retained in desired angle and spacing.

The louvered fence brackets 100 or the louvered fence brackets 210 of the louvered fence bracket system 200 may have bracket bodies (e.g., rectangular bracket body 111 and vertical bracket body 211, respectively), which can be considered to be "shelves," spaced and angled to support each louver board 500 (see FIGS. 2 and 4). The louvered fence brackets 100 and the louvered fence brackets 210 of the louvered fence bracket system 200 may be on two fence posts 603 (see FIGS. 2 and 4) opposite one another to support louver board 500 at the proper and desired spacing and angle. After the louvered fence brackets 100 or the louvered fence brackets 210 of the louvered fence bracket systems 200 are affixed to fence posts 603, louver boards 500 can be slid into the aligned "shelves" (rectangular bracket body 111 and vertical bracket body 211, respectively) at the same heights on the louvered fence brackets 100 or the louvered fence brackets 210 of the louvered fence bracket system 200.

The dimensions of the louvered fence bracket 100 components or the louvered fence bracket system 200 components can vary as desired and needed to accommodate different lumber types and sizes of the louver board 500. Typical use cases may include louver boards 500 with thickness of 5/4" and width of 6", thickness of 1" and width of 6", thickness of 5/4" and width of 6", thickness of ⅝" and width of 6", thickness of 1" and width of 4", and thickness of ⅝" and width of 4".

With reference to FIGS. 1-2, an embodiment of the louvered fence bracket 100 for retaining multiple louver boards 500 (shown in FIG. 2) in a desired angle and a desired spacing for a fence or a similar structure is shown. The louvered fence bracket 100 comprises at least two bracket portions 110 and at least one parallelogrammatic support body portion 120. The bracket portion 110 each comprises a rectangular bracket body 111, a first sliding prevention portion 112, and at least one second sliding prevention portion 113. The first sliding prevention portion 112 attaches perpendicularly to a width 114 of the rectangular bracket body 111 to form an end bracket for receiving and retaining a louver board 500 (shown in FIG. 2). The at least one second sliding prevention portion 113 attaches perpendicularly to a length 115 of the rectangular bracket body 111 to form at least one side bracket for receiving and retaining the louver board 500. The at least one parallelogrammatic support body portion 120 (also referred to as support body portion 120) is comprised of a first short side 121, a second short side 122, and at least one fastener receiver 123. The at least one parallelogrammatic support body portion 120 attaches to a second length 116 of the rectangular bracket body 111 of one of the at least two bracket portions 110 by the first short side 121 and the length 115 of the rectangular bracket body 111 of another of the at least two bracket portions 110 by the second short side 122 to align the at least two bracket portions 110 at the desired (typically uniform) angle and the desired (typically even/uniform) spacing. The at least one fastener receiver 123 may be used to attach the louvered fence bracket 100 to a fencing post 603 (shown in FIG. 2) using a fastener.

In an embodiment shown in FIGS. 1-2, the louvered fence bracket 100 has three bracket portions 110 and two parallelogrammatic support body portions 120. In such embodiment, a first bracket portion 110 is connected to a second bracket portion 110 with a first parallelogrammatic support body portion 120 and the second bracket portion 110 is connected to a third bracket portion 110 with a second parallelogrammatic support body portion 120. However, the louvered fence bracket 100 may be comprised of any number of bracket portions 110 and any number of parallelogrammatic support body portions 120 as desired.

Further, in the embodiment shown in FIG. 1, one first sliding prevention portion 112 forms the end bracket of each of the three bracket portions 110 and two second sliding prevention portions 113 form two side brackets of each of the three bracket portions 110. However, any number of first sliding prevention portion 112 and any number of second sliding prevention portion 113 may be used as desired.

Still further, in the embodiment shown in FIG. 1, the at least one fastener receiver 123 of each of the at least two parallelogrammatic support body portions 120 may include at least one hole or other suitable opening for securing the louvered fence bracket 100 to the fencing post 603 using at least one fastener, which can be a screw, or any other means known in the art such as glue, tongue and groove, nail, bolt, etc.

As shown in the embodiment in FIG. 1, the louvered fence bracket 100 may be one piece. One way of making such one-piece louvered fence bracket 100 is to weld the components, the bracket portion 110 and the parallelogrammatic support body portion 120, of the louvered fence bracket 100 together. In such embodiment, the first bracket portion 110 may be welded to the second bracket portion 110 via the first parallelogrammatic support body portion 120 and the second bracket portion 110 may be welded to a third bracket portion 110 via a second parallelogrammatic support body portion 120 to form an entire, "one-piece" louvered fence bracket 100.

In FIG. 2, one fencing post 603 (right side one) of a fence using the louvered fence bracket 100 of FIG. 1 is shown; however, in some embodiments, there may be at least two fencing posts 603, each with the louvered fence bracket 100 attached to support the louver boards 500 in between the louvered fence brackets 100 at a desired spacing and angle.

In an embodiment, the louvered fence bracket 100 may further comprise at least one louver support for preventing twisting and warping of at least one louver board 500. The louvered fence bracket 100 also may further comprise at least one cap board for securing at least one louver board 500 in place in the louvered fence bracket 100.

With reference to FIGS. 3-6 and 9, an embodiment of the louvered fence bracket system 200 for retaining multiple louver boards 500 (shown in FIG. 3) in a desired angle and a desired spacing for a fence or a similar structure is shown. The louvered fence bracket system 200 is comprised of at least one louvered fence bracket 210, a side support board 230, and a fascia mount 240. Each louvered fence bracket 210 is comprised of a vertical bracket body 211, a sliding prevention portion 212, a top connection portion 213, and a bottom connection portion 214. The vertical bracket body 211 has a height 215, a top end 216 with an alignment receiver 217 and a notch forming portion 218, and a bottom end 219 with a notch forming portion 220. The sliding prevention portion 212 is attached at the desired angle to a first side 221 of the vertical bracket body 211 for receiving and retaining a louver board. The top connection portion 213 is located at the top end 216 of the vertical bracket body 211, and the bottom connection portion 214 is located at the bottom end 219 of the vertical bracket body 211. In such an embodiment, multiple louvered fence brackets 210 can be coupled together by connecting the top end 216 of one of the at least one louvered fence bracket 210 to the bottom end 219 of another one of the at least one louvered fence bracket 210. A notch 251 (see FIG. 6) forms from the notch forming portion 218 of the top end 216 of the one of the at least one louvered fence bracket 210 and the notch forming portion 220 of the bottom end 219 of the another one of the at least one louvered fence bracket 219 when connected. The notches 251 formed by the notch forming portions 218, 220 in FIG. 3 (and FIGS. 5 and 6) may be half diamond or isosceles triangle shaped, but could be any suitable shape or form known in the art. Each of the vertical bracket body 211 of the at least one louvered fence bracket 210 is attached to the side support board 230 using the alignment receiver 217 of the top end 216 of the vertical bracket body 211 of the at least one louvered fence bracket 210. The side support board 230 is also adapted for retaining ends of the louver boards 500 in place. The fascia mount 240 attaches perpendicularly to the side support board 230. The fascia mount 240 is adapted for aligning a second side 222 of each of the at least one louvered fence bracket 210 and adapted for attaching the louvered fence bracket system 200 to the fence post 603.

Figure 3:
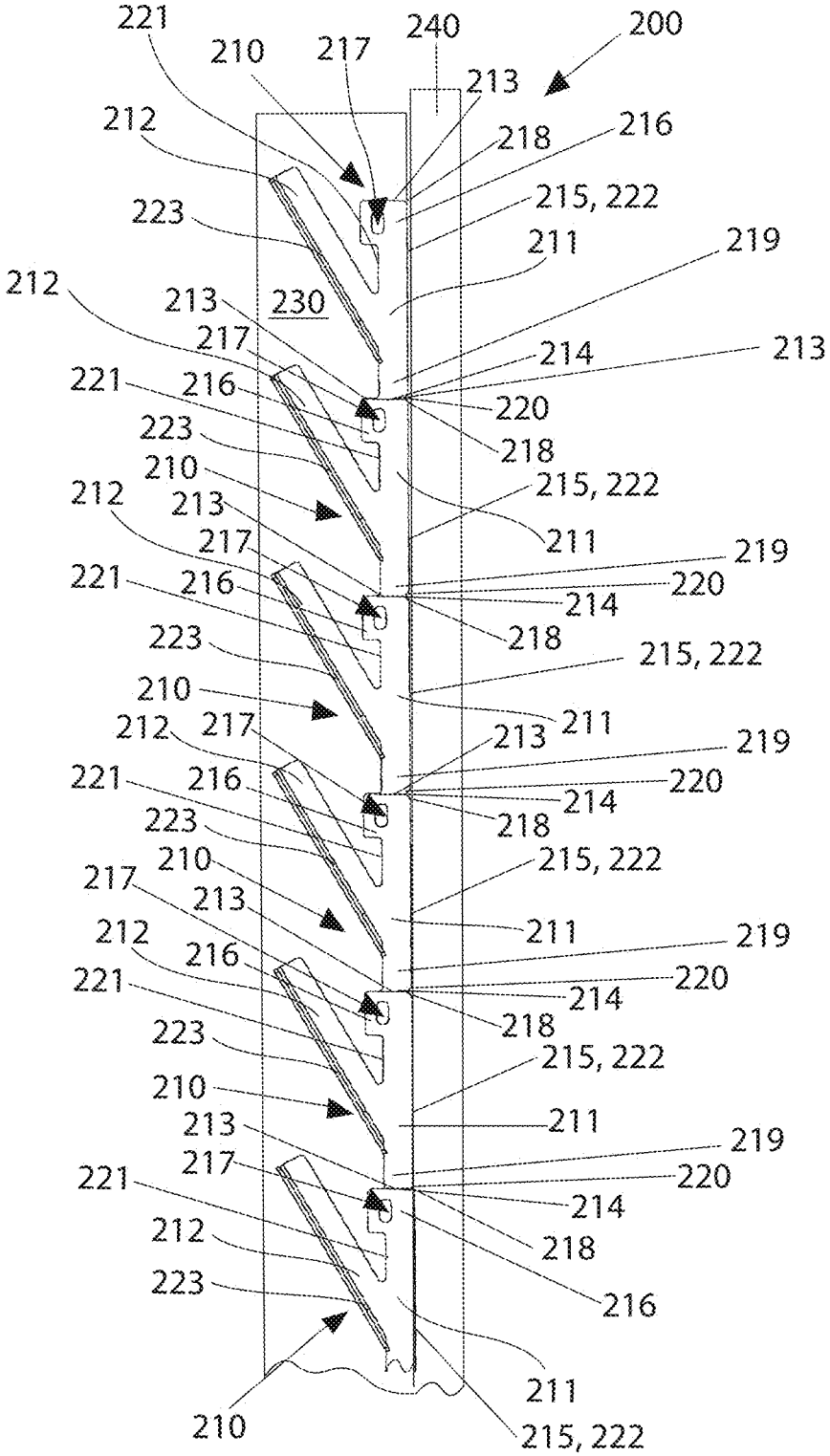
FIG. 3 is a side view of an embodiment of a louvered fence bracket system, showing how louvered fence brackets can be mounted on a side support board and a fascia mount (fascia board).
Figure 5:
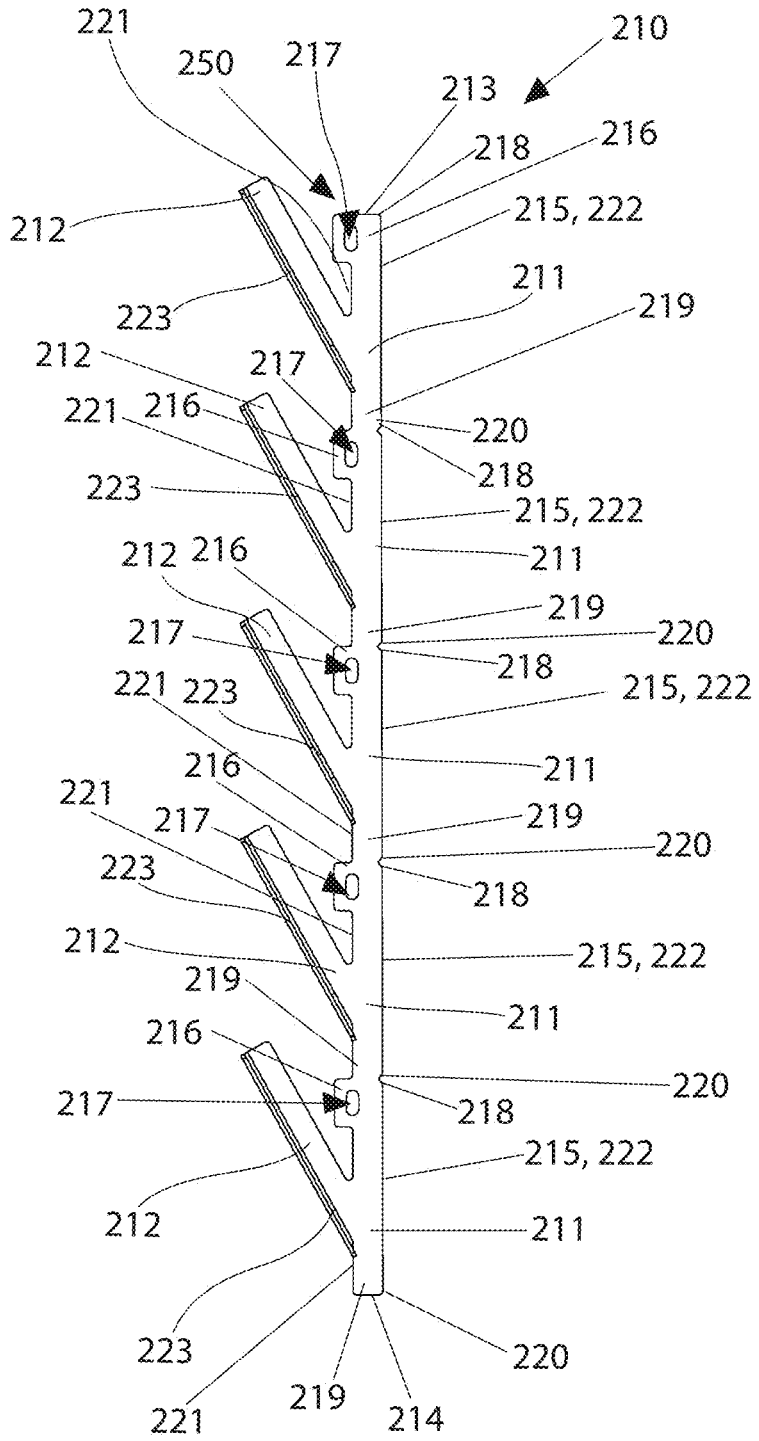
FIG. 5 is a side view of an embodiment of the at least one louvered fence bracket of the louvered fence bracket system, showing how multiple louvered fence brackets can be connected by welding, forming one continuous louvered fence bracket body for use.
Figure 6:
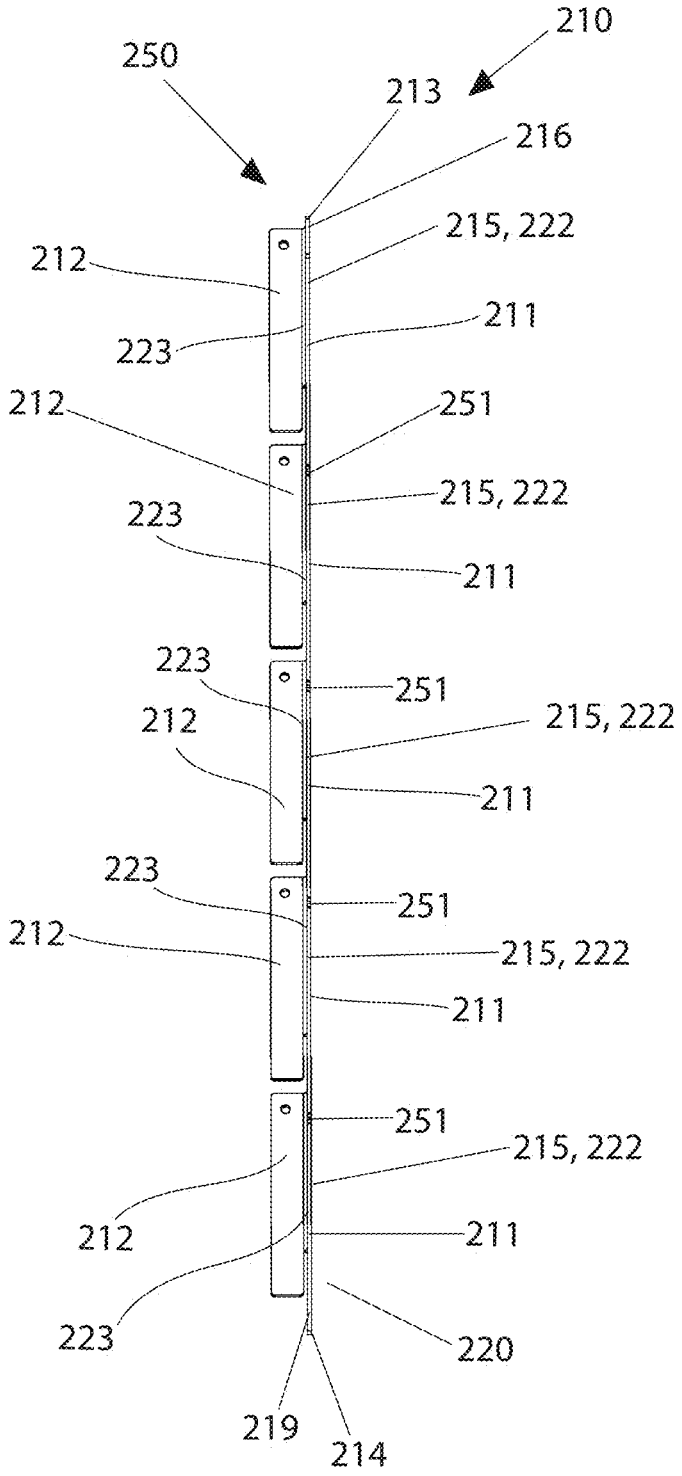
FIG. 6 is a front view of the at least one louvered fence bracket of the louvered fence bracket system of FIG. 5

According to an embodiment as shown in FIGS. 3, 5, and 6, the sliding prevention portion 212 of the at least one louvered fence bracket 210 further comprises a bend 223 adapted for receiving and retaining an edge (or an end) of the louver board 500. In an embodiment, the fascia mount 240 may be further adapted for overlaying the fencing post 603, as shown in FIG. 4. In an embodiment, as shown in FIG. 5, the multiple louvered fence brackets 210 (also marked as 250 in FIGS. 5-6) are connected by welding together the top end 216 of the vertical bracket body 211 of one of the at least one louvered fence bracket 210 and the bottom end 219 of the vertical bracket body 211 of another one of the at least one louvered fence bracket 210, thereby forming one multiple louvered fence bracket body 250 from individual louvered fence brackets 210.

For the louvered fence bracket system 200 as shown in FIGS. 3-6, the construction of louver boards 500 with this system 200 requires either fascia boards 240 as fascia mounts 240 to cover both the front edges of the fence post 603 and the louvered fence brackets 210 of the louvered fence bracket system 200, or a metal L-bracket fascia (not shown) as fascia mounts 240 which covers the ends of the louvered fence brackets 210 of the louvered fence bracket system 200. Either fascia boards 240 or metal L-bracket fascia serves as a stop for the louver boards 500, which may slide into the angled spaces, resulting in a complete installation and more finished appearance.

For the louvered fence bracket system 200 as shown in FIGS. 3-6, the notches 251 formed from the notch forming portion 218 of the top end 216 of one of the at least one louvered fence bracket 210 and the notch forming portion 220 of the bottom end 219 of another of the at least one louvered fence bracket 219 facilitate accurate addition or reduction of number of louver boards 500. These notches 251 are adapted to serve as a guide for a cutting tool and may indicate where to cut in order to shorten or lengthen the multiple louvered fence bracket body 250 formed by multiple louvered fence brackets 210 as desired. The height 215 of the vertical bracket body 211 of the at least one louvered fence bracket 210 allows for correct spacing for the louver boards 500. Thus, the end-to-end connection (the bottom end 219 of the vertical bracket body 211 of one louvered fence bracket 210 to the top end 216 of the vertical bracket body 211 of another one of the louvered fence brackets 210) allows for correct louver board 500 spacing on the multiple louvered fence bracket body 250 when cut within the marked notch 251 areas.

Figure 7:
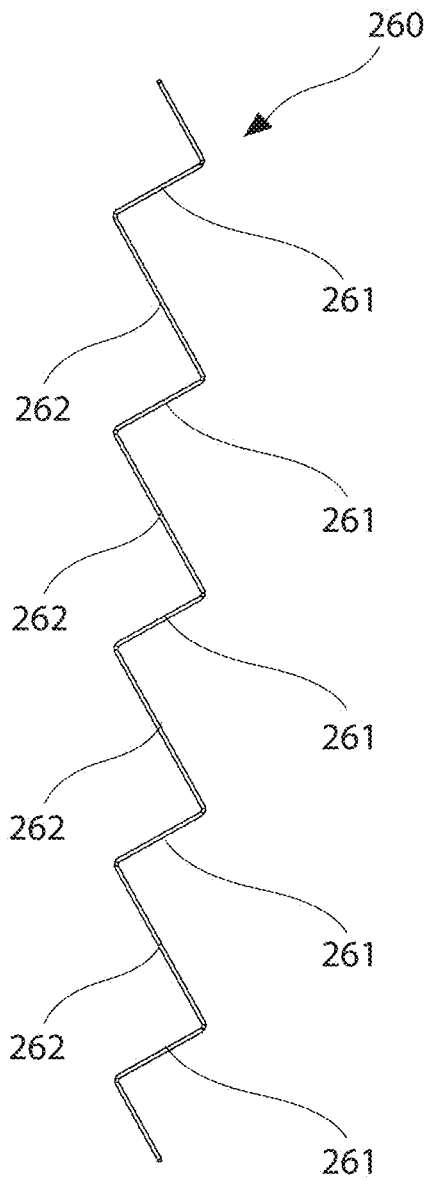
FIG. 7 is a side view of a cap board for the embodiment of the louvered fence bracket system shown in FIGS. 5-6.
Figure 8:
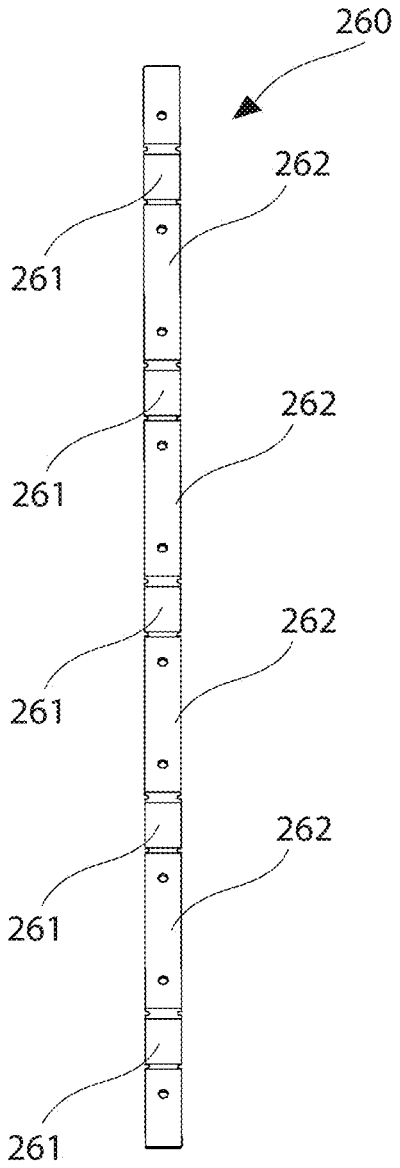
FIG. 8 is a front view of the cap board of the louvered fence bracket system in FIG. 7.
Figure 9:
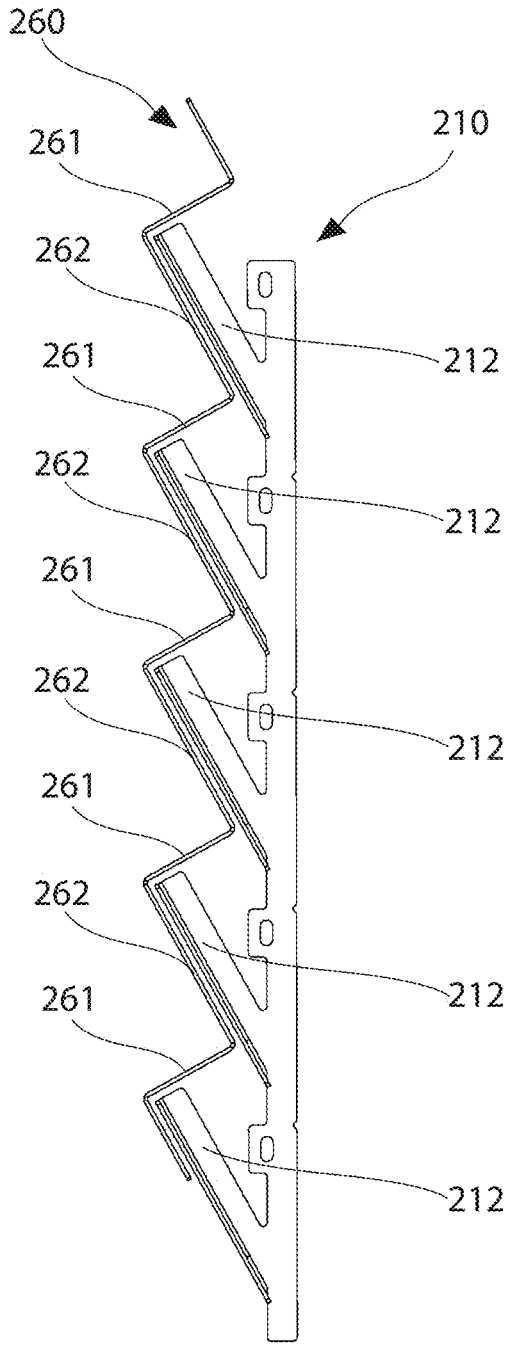
FIG. 9 is a side view of the cap board shown in FIG. 7 and the welded louvered fence brackets shown in FIG. 5, showing how the cap board may attach to the louvered fence brackets.

Referring to FIGS. 7-9, the louvered fence bracket system 200 may further comprise at least one cap board 260 in place in the louvered fence bracket system 200. As shown in FIGS. 7-9, the at least one cap board 260 may have a zigzag shape to cover multiple louvered fence brackets 210 and multiple louver boards 500. The zigzag shape of each of the at least one cap board 260 may be comprised of at least one short portion 261 and at least one long portion 262, wherein each of the short portion 261 is shaped to cover a top of one of the sliding prevention portion 212 of the at least one louvered fence bracket 210 and a top of one of the multiple louver boards 500 held by the respective louvered fence bracket 210. The at least one cap board 260 may be secured to the vertical bracket body of the louvered fence bracket by at least one L-bracket.

In an embodiment, the at least one L-bracket can easily be added to the inside of the louvered fence bracket 210 of the louvered fence bracket system 200 so a 2"×4" cap board can be installed across the top or bottom of the louvered area. This may finish the louvered fence area so it can be easily mown or trimmed along the bottom, for example, without damaging the louver boards 500, and can be replaced when needed, increasing the ease of maintenance. Further, in an embodiment, louver boards 500 can be easily secured from the back side because the louver boards 500 are held in place in the front by fascia mount 240. Additional securing of each louver board 500 is also possible from the back of the louvered fence bracket 210 of the louvered fence bracket system 200.

In an embodiment, the louver boards 500 may be mounted vertically to a structure (other than vertical fence posts) rather than horizontally using the louvered fence bracket 100 or the louvered fence bracket system 200. In an embodiment, the louvered fence bracket 100 or the louvered fence bracket system 200 can be used in a pergola where the surfaces they are attached to are not fence posts and are not parallel to one another.

In an embodiment, the louvered fence bracket 100 or the louvered fence bracket system 200 can be further comprised of a support (louver support) that work in conjunction with the louvered fence bracket 100 or the louvered fence bracket system 200, to prevent twisting and warping, especially of long louver boards 500.

A method of building a fence using the louvered fence bracket 100 comprises the steps of: 1) securing at least two fence posts 603 such that a surface of each of the fence posts 603 face one another; 2) aligning the at least one parallelogrammatic support body portion 120 of the bracket portion 110 of one louvered fence bracket 100 with the front edge of one of the at least two fence posts 603 (a first fence post); 3) attaching the louvered fence bracket 100 to the first fence post 603 using a fastener that is appropriate for the fence post material, such as wood screws or lag screws for wood posts and self-tapping metal screws for metal posts; 4) aligning the at least one parallelogrammatic support body portion 120 of the bracket portion 110 of another louvered fence bracket 100 with the front edge of another of the at least two fence posts 603 (a second fence post), and leveling the another louvered fence bracket 100 with the louvered fence bracket 100 attached to the first fence post 603; 5) sliding louver boards 500 into position between the two louvered fence brackets 100; and 6) using the appropriate fastener to attach each louver board 500 to the two louvered fence brackets 100.

Figure 10:
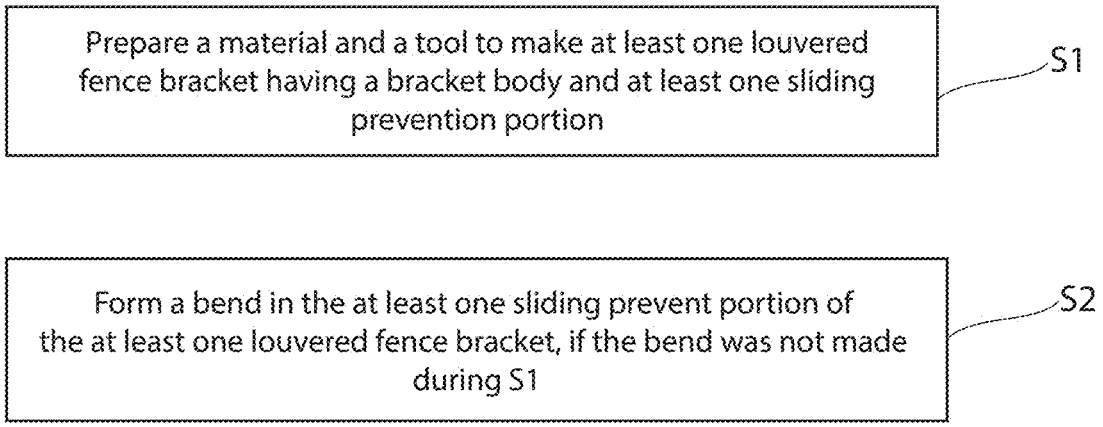
FIG. 10 is a flowchart showing general steps of making the louvered fence bracket or the at least one louvered fence bracket of the louvered fence bracket system.

There are several methods for making the louvered fence bracket 100 and the at least one louvered fence bracket 210 of the louvered fence bracket system 200. Generally, as shown in the flowchart in FIG. 10, the first step S1 involves preparing a material and a tool to make at least one louvered fence bracket 100 or louvered fence bracket 210 of the louvered fence bracket system 200 having at least one sliding prevention portion 112 or 113, 212, respectively. If a bend 223 was not formed as a part of the first step S1, then a bend 223 in the at least one sliding prevention portion 112 or 113, 212, respectively, is formed at the second step S2.

One method of making the louvered fence bracket 100 and the at least one louvered fence bracket 210 of the louvered fence bracket system 200 is to laser cut and bend 223 with a brake press. Such method of manufacturing the louvered fence bracket 100 or the at least one louvered fence bracket 210 of the louvered fence bracket system 200 is comprised of following steps: 1) cutting a material to make at least one flat louvered fence bracket having a bracket body and at least one sliding prevention portion; and 2) using a brake press machine to form a bend in the at least one sliding prevention portion of the at least one louvered fence bracket. Lasers, waterjet, or other cutting tool known in the art may be used to cut the material.

Another method is to laser cut, then bend with a metal stamping tool and press. Such method of manufacturing the louvered fence bracket 100 or the at least one louvered fence bracket 210 of the louvered fence bracket system 200 is comprised of following steps: 1) obtaining a custom stamping or die tool; 2) cutting a material to make at least one flat louvered fence bracket having a bracket body and at least one sliding prevention portion; 3) mounting the stamping or die tool onto a stamping press; and 4) using the stamping press on the at least one sliding prevention portion of the at least one louvered fence bracket at least one flat to form a bend in the at least one sliding prevention portion of the at least one louvered fence bracket. The custom-built stamping die/tool allows one tool to be used over and over. Lasers, waterjet, or other cutting tool known in the art may be used to cut the material.

Another method is to cut and bend with a metal stamping tool and press. Such method of manufacturing the louvered fence bracket 100 or the at least one louvered fence bracket 210 of the louvered fence bracket system 200 is comprised of following steps: 1) obtaining a custom stamping or die tool; 2) mounting a stamping or die tool onto a stamping press; 3) feeding bracket material into the stamping press; and 4) using the stamping press on the bracket material to form at least one flat louvered fence bracket having a bracket body and at least one sliding prevention portion and form a bend in the at least one sliding prevention portion of the at least one louvered fence bracket. The custom-built stamping die/tool allows one tool to be used over and over.

Another method is to use a mold. Such method of manufacturing the louvered fence bracket 100 or the at least one louvered fence bracket 210 of the louvered fence bracket system 200 is comprised of following steps: 1) obtaining a custom mold; and 2) injecting a bracket material into the mold to form at least one flat louvered fence bracket having a bracket body and at least one sliding prevention portion with a bend. The custom mold allows one tool to be used over and over, and the custom mold should be one that is appropriate for the material used for the louvered fence bracket 100 or the at least one louvered fence bracket 210 of the louvered fence bracket system 200.

Another method is to use a 3D printer. Such method of manufacturing the louvered fence bracket 100 or the at least one louvered fence bracket 210 of the louvered fence bracket system 200 is comprised of following step: using a 3D printer to print at least one flat louvered fence bracket having a bracket body and at least one sliding prevention portion with a bend.

The methods of making the louvered fence bracket 100 or the at least one louvered fence bracket 210 of the louvered fence bracket system 200 is not limited to the methods mentioned above. Any other method that is appropriate for the material used and known or will be known in the art may be used.

The indefinite articles "a" and "an," as used herein in the specification and in the claims, unless clearly indicated to the contrary, should be understood to mean "at least one."

In the claims, as well as in the specification above, all transitional phrases such as "comprising," "including," "carrying," "having," "containing," "involving," "holding," "composed of," and the like are to be understood to be open-ended, i.e., to mean including but not limited to.

Embodiments of the present disclosure have been described with reference to the embodiments illustrated in the attached drawing figures. However, equivalents may be employed and substitutions made herein without departing from the scope of the invention as recited in the claims. Therefore, it will be apparent to those skilled in the art that many changes and modifications may be made without departing from the claimed subject matter in its broader aspects. The appended claims are intended to cover all such changes and modifications as fall within the true spirit and scope of the invention.

What is claimed is:

1. A louvered fence bracket for retaining multiple louver boards in a desired angle and a desired spacing for a fence or a similar structure, the louvered fence bracket comprising:

at least two bracket portions, each bracket portion comprising:

a rectangular bracket body;

a first sliding prevention portion attached perpendicularly to a width of the rectangular bracket body to form an end bracket for receiving and retaining a louver board; and at least one second sliding prevention portion attached perpendicularly to a length of the rectangular bracket body to form at least one side bracket for receiving and retaining the louver board; and at least one parallelogrammatic support body portion comprising:

a first short side and a second short side, wherein the at least one parallelogrammatic support body portion attaches to a second length of the rectangular bracket body of one of the at least two bracket portions by the first short side and the length of the rectangular bracket body of another of the at least two bracket portions by the second short side to align the at least two bracket portions at the desired angle and the desired spacing; and at least one fastener receiver for attaching the louvered fence bracket to a fencing post using a fastener.

2. The louvered fence bracket of claim 1, wherein the at least two bracket portion is at least three bracket portions and the at least one parallelogrammatic support body portion is at least two parallelogrammatic support body portions, wherein a first bracket portion is connected to a second bracket portion with a first parallelogrammatic support body portion and the second bracket portion is connected to a third bracket portion with a second parallelogrammatic support body portion.

3. The louvered fence bracket of claim 2, wherein the at least one second sliding prevention portion of each of the at least three bracket portions are at least two second sliding prevention portions to form at least two side brackets.

4. The louvered fence bracket of claim 3, wherein the at least one fastener receiver of each of the at least two parallelogrammatic support body portions is at least one hole for attaching the louvered fence bracket to the fencing post using at least one screw.

5. The louvered fence bracket system of claim 2, wherein the first bracket portion is welded to the second bracket portion with the first parallelogrammatic support body portion and the second bracket portion is welded to a third bracket portion with a second parallelogrammatic support body portion to form the louvered fence bracket.

6. The louvered fence bracket of claim 1, wherein the material for the louvered fence bracket comprises one or more of sheet metal, plastic, or resin.

7. The louvered fence bracket of claim 1, further comprising at least one louver support for preventing twisting and warping of at least one louver board.

8. The louvered fence bracket of claim 1, further comprising at least one cap board for securing at least one louver board in place in the louvered fence bracket.

9. A louvered fence bracket system for retaining multiple louver boards in a desired angle and a desired spacing for a fence or a similar structure, the louvered fence bracket system comprising:

at least one louvered fence bracket, each louvered fence bracket comprising:

a vertical bracket body having a height, a top end with an alignment receiver and a notch forming portion, and a bottom end with a notch forming portion;

a sliding prevention portion attached at the desired angle to a first side of the vertical bracket body for receiving and retaining a louver board;

a top connection portion at the top end of the vertical bracket body; and a bottom connection portion at the bottom end of the vertical bracket body, wherein multiple louvered fence brackets can be connected together by connecting the top end of one of the at least one louvered fence bracket to the bottom end of another one of the at least one louvered fence bracket, wherein a notch forms from the notch forming portion of the top end of the one of the at least one louvered fence bracket and the notch forming portion of the bottom end of the another one of the at least one louvered fence bracket when connected;

a side support board for attaching each of the vertical bracket body of the at least one louvered fence bracket using the alignment receiver of the top end and retaining ends of the louver boards in place;

a fascia mount attached perpendicularly to the side support board, for aligning a second side of vertical bracket body of each of the at least one louvered fence bracket and adapted for attaching the louvered fence bracket system to the fence post.

10. The louvered fence bracket system of claim 9, wherein the sliding prevention portion further comprises a bend adapted for receiving and retaining an edge of the louver board.

11. The louvered fence bracket system of claim 9, wherein the material for the louvered fence bracket system comprises one or more of sheet metal, plastic, or resin.

12. The louvered fence bracket system of claim 9, where the fascia mount is further adapted for overlaying the fence post.

13. The louvered fence bracket system of claim 9, wherein the multiple louvered fence brackets are connected by welding together the top end of the vertical bracket body of one of the at least one louvered fence bracket and the bottom end of the vertical bracket body of another one of the at least one louvered fence bracket, thereby forming one multiple louvered fence bracket body.

14. The louvered fence bracket system of claim 9, further comprising at least one louver support for preventing twisting and warping of at least one louver board.

15. The louvered fenced bracket system of claim 9, wherein the fascia mount is a fascia board.

16. The louvered fence bracket system of claim 9, wherein the fascia mount is a metal L-bracket fascia.

17. The louvered fence bracket system of claim 9, further comprising at least one cap board for securing at least one louver board in place in the louvered fence bracket system.

18. The louvered fence bracket system of claim 13, further comprising at least one cap board for securing at least one louver board in place in the louvered fence bracket system, wherein the at least one cap board has a zigzag shape to cover multiple louvered fence brackets and multiple louver boards.

19. The louvered fence bracket system of claim 18, wherein the zigzag shape of each of the at least one cap board is comprised of at least one short portion and at least one long portion, wherein each of the short portion is shaped to cover a top of one of the sliding prevention portion of the at least one louvered fence bracket and a top of one of the multiple louver boards held by the respective louvered fence bracket.

20. The louvered fence bracket system of claim 17, wherein the at least one cap board is secured to the vertical bracket body of the louvered fence bracket by at least one L-bracket.

* * * * *